United States Patent [19]

Wash et al.

[11] Patent Number: 5,039,994

[45] Date of Patent: Aug. 13, 1991

[54] DIPOLE ARRAYS

[75] Inventors: Richard G. Wash; Edmund W. Woloszczuk, both of Essex, England

[73] Assignee: The Marconi Company Ltd., Chelmsford, Great Britain

[21] Appl. No.: 434,461

[22] Filed: Nov. 13, 1989

Related U.S. Application Data

[63] Continuation of Ser. No. 241,787, Sep. 6, 1988, abandoned, which is a continuation-in-part of Ser. No. 810,275, Dec. 18, 1985, abandoned.

[30] Foreign Application Priority Data

Dec. 20, 1984 [GB] United Kingdom ..... 8432186
Sep. 18, 1985 [GB] United Kingdom ..... 8523076

[51] Int. Cl.[5] ..... H01Q 21/12; H01Q 1/52

[52] U.S. Cl. ..... 343/813; 343/814; 343/815; 343/816; 343/841; 343/848

[58] Field of Search ..... 343/814–821, 343/807, 795, 853, 841, 813

[56] References Cited

U.S. PATENT DOCUMENTS

| | | | |
|---|---|---|---|
| 2,130,033 | 9/1938 | Scharlu | 343/813 |
| 2,455,403 | 12/1948 | Brown | 343/816 |
| 2,573,914 | 11/1951 | Landon | 343/814 |
| 2,691,102 | 10/1954 | Masters | 343/800 |
| 3,541,559 | 11/1970 | Evans | 343/795 |
| 3,545,001 | 12/1970 | Giller | 343/817 |
| 3,681,770 | 8/1972 | Alford | 343/841 |
| 3,887,925 | 6/1975 | Ranghelli et al. | 343/795 |
| 4,131,896 | 12/1978 | Miller | 343/815 |
| 4,460,899 | 7/1984 | Schmidt et al. | 343/841 |

FOREIGN PATENT DOCUMENTS

| | | | |
|---|---|---|---|
| 0048190 | 3/1982 | European Pat. Off. | 343/895 |
| 2123215 | 1/1984 | United Kingdom . | |
| 2135829 | 9/1984 | United Kingdom | 343/815 |

*Primary Examiner*—Michael C. Wimer
*Attorney, Agent, or Firm*—Spencer & Frank

[57] ABSTRACT

An antenna formed by an array of dipole elements fed by a triplate or stripline system is provided with earthed posts between the dipoles. These posts prevent radiation from one dipole being received by others thereby improving the antenna efficiency.

8 Claims, 3 Drawing Sheets

DIPOLE ARRAYS

This application is a continuation of application Ser. No. 07/241,787 filed Sept. 6th, 1988, now abandoned, which is a continuation-in-part of application Ser. No. 06/810,275 filed Dec. 18th, 1985, now abandoned.

BACKGROUND OF THE INVENTION

This invention relates to an antenna comprising an array of dipoles arranged in rows and columns.

A well known undesirable characteristic of such antennas is that strong coupling exists between adjacent dipoles. It is difficult to predict the nature of the coupling in any particular design and therefore to select the correct phase and amplitude values to be applied to each dipole in order to achieve a required beam shape. This problem is set out in a paper entitled "Mutual Coupling in Two-Dimensional Arrays" by J. Blass and S. J. Rabinowitz published by the Institute of Radio Engineers Western Convention Record Vol 1, Part 1 pages 134–150.

SUMMARY OF THE INVENTION

This invention provides an antenna comprising an array of dipoles arranged in rows and columns in which a conductive projection is interposed between elements spaced in the E plane thereby reducing mutual coupling between the elements.

By taking mutual coupling into consideration it is possible using conventional techniques to obtain a required beam shape; but the effects of the mutual coupling are such that when it is desired to scan the beam the beam shape may be lost.

The invention is therefore of particular value in antennas adapted to produce a scanning beam and is considered to be of particular application to antenna structures of the type in which the dipoles are formed on the ends of arms extending from and distributed along one edge of a stripline or triplate structure for feeding energy to the dipoles. In such an arrangement conductive projections can conveniently be formed by protrusions from the edge, and preferably from a conductive layer or layers forming part of the stripline or triplate structure. The aforementioned arms and the dipoles can similarly be formed from further extensions of the same conductive layer or layers. In one arrangement the dipoles and the arms form T shaped extensions of the ground planes of a triplate structure.

BRIEF DESCRIPTION OF THE DRAWINGS

Two ways in which the invention may be performed will now be described by way of example with reference to the accompanying drawings in which.

DESCRIPTION OF THE PREFERRED EMBODIMENT

Figure 1:
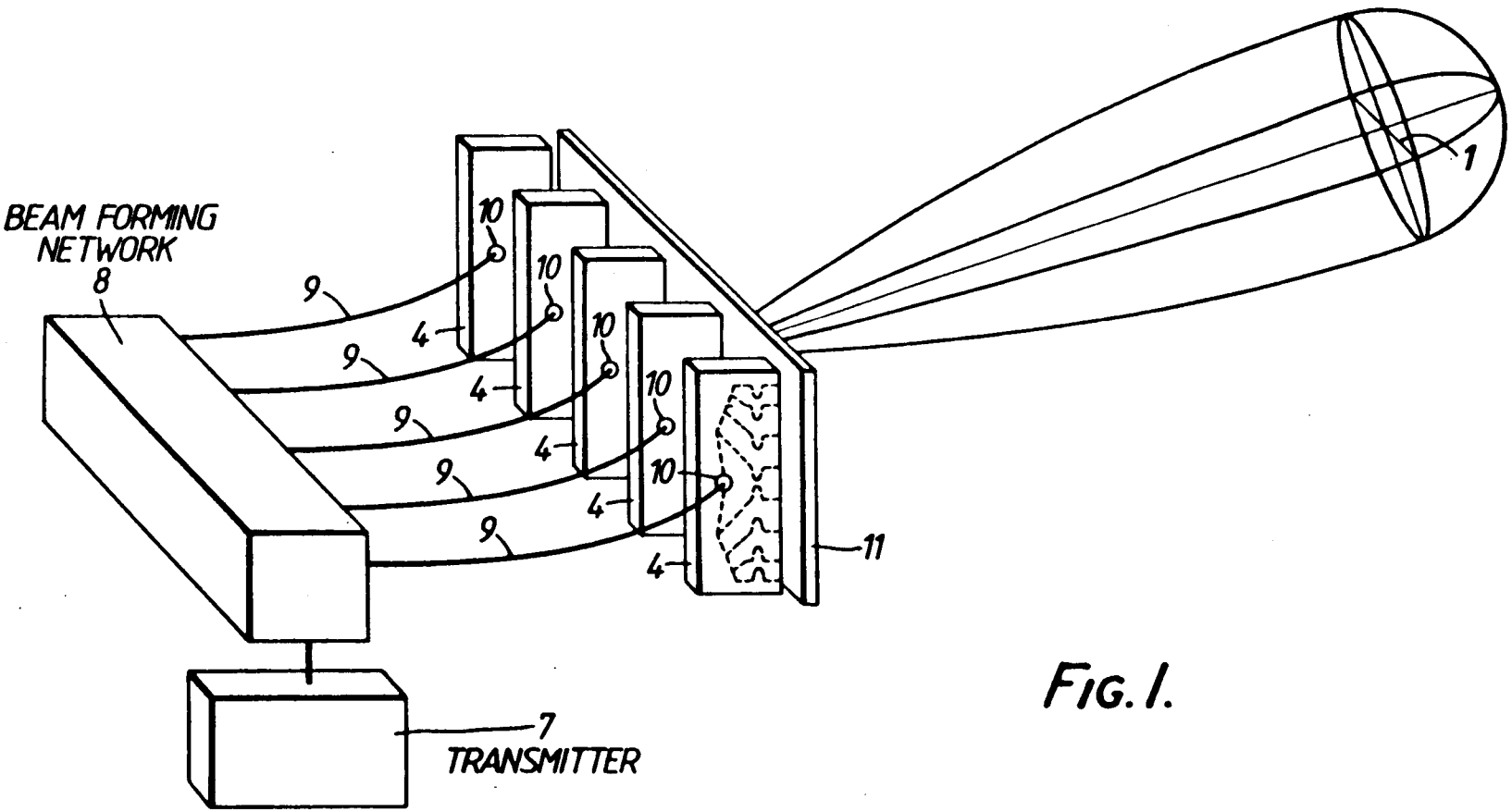
FIG. 1 shows in very diagrammatic form an antenna constructed in accordance with the invention and seen from behind.

The purpose of the embodiment of the invention illustrated in FIG. 1 is to produce a beam which is narrow in azimuth as indicated at 1 in FIG. 1 and to scan this in azimuth. The vertical shape of the beam is wider as shown in FIG. 1.

The antenna includes an array of dipoles 3 (FIG. 2) arranged in vertical or longitudinal columns and horizontal or lateral rows. Each vertical column of dipoles is fed by a triplate 4 (FIGS. 1 and 3) having an inner conductor 5 (FIG. 3) and outer conductors 6.

Energy from a transmitter 7 is divided by a beam forming network 8 onto co-axial lines 9 with appropriate amplitude and phase adjustment to define the required beam shape in azimuth. The relative phases are electronically varied to provide horizontal scanning in azimuth. Each line 9 is connected by a socket 10 to one of the triplates 4. Each triplate forms a splitter designed to feed the energy to the individual dipoles 3 of a column with different relative phases and amplitudes to provide the specified vertical beam shape. The dipoles are not visible on FIG. 1, being hidden by a ground plate 11 which is common to all the dipoles of all the triplates.

Each vertical assembly of dipoles and its associated triplate is a discrete physical unit and these units are identical.

Figure 2:
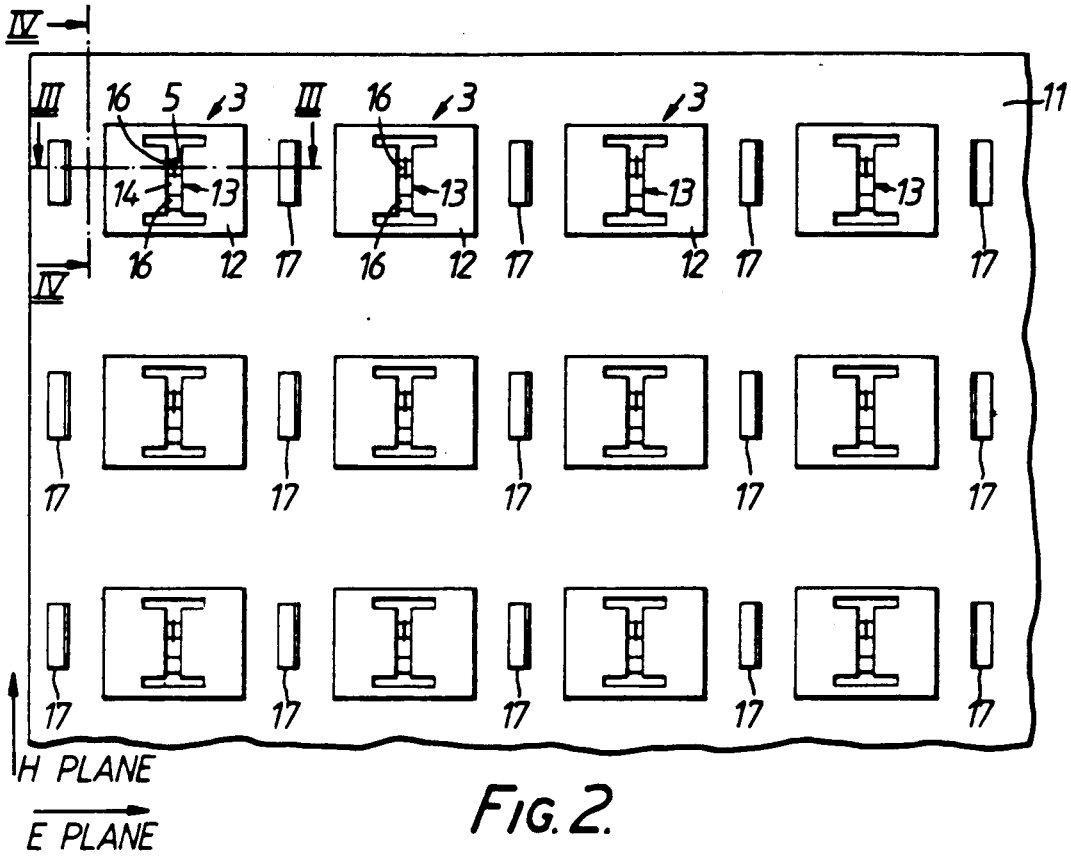
FIG. 2 is a front elevation of a part of the antenna of FIG. 1 (showing twelve dipoles)
Figure 4:
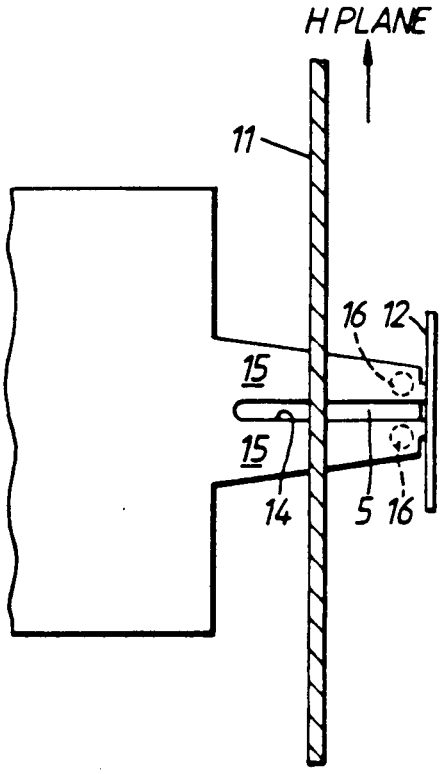
FIG. 4 is a vertical cross section through the line IV—IV on FIG. 2.

Each dipole is built along similar principles to those described in our patent specification GB No. 2113476 and consists of a conductive plate 12 formed with an I shaped slot 13 (FIG. 2). Referring to FIG. 4 each ground plate of the triplate is slotted at 14 to form arms 15. The top arm 15 of the ground plate visible in FIG. 4 is connected to one side of the slot whilst the bottom arm 15 of the other ground plane is connected to the other side of the slot. A rod 16 connects the top arms together, and another rod 16 connects the bottom arms together. The rod connecting the top arms is also connected to the inner conductor 5. A conductive sheet 11, which is common to all the dipoles, forms a ground reflector which provides a unidirectional radiation pattern. The distance between the dipoles 3 should ideally be one quarter of a wavelength at the center frequency. The way in which the illustrated dipole operates is complex and is of no relevance to the present invention which is equally applicable to an antenna formed from dipoles of conventional construction. It is sufficient to note that the effect of the illustrated design is to radiate energy in the manner of a conventional dipole having a horizontal E plane and vertical H plane as illustrated, but which has a wide bandwidth and matches a standard 50 ohm feed.

In a system as described so far there is a problem as follows. Due to strong horizontal coupling between dipole elements of a vertical column, the required elevation beam shape of FIG. 1 is lost during horizontal scanning. This problem is one which is well known in the art and to which no entirely satisfactory solution has previously been found. In the illustrated embodiment the problem is overcome to a satisfactory extent by the introduction of parasitic conductive projections or posts 17 in the rows between dipoles in each row in the E plane. The terms "posts" or "projections" as used herein and in the claims, as differentiated from walls, for example, characterize the members by narrowness in the direction perpendicular to the E-plane (the longitudinal direction). As shown in FIG. 2, in the disclosed embodiment, the posts 17 have a lesser extent in this longitudinal direction than the respective dipoles adjacent thereto and also have a lesser extent in this longitudinal direction than the space between adjacent posts. The action of a parasitic projection or post 17 is to absorb some of the power from a dipole and to re-radiate it at a low angle to the ground plane 11 to provide for a broader beam from individual dipoles as is required for a broad beam scanning. At the same time the parasitic element prevents the power being radiated from one element to the adjacent element or elements in the E plane.

Figure 3:
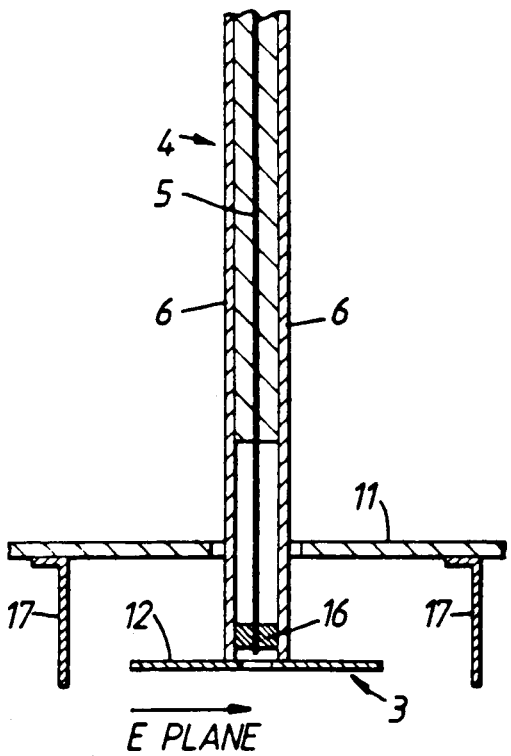
FIG. 3 is a horizontal cross-section through the line III—III on FIG. 2.

The parasitic projections (posts) are frequency sensitive and their lengths need to be accurately tuned empirically for a given frequency of operation to minimise mutual coupling. The tuned electrical length (which is longer than the physical length) will in practice normally be less than a quarter of a wavelength (2/4) depending on the thickness and cross-sectional area of the projection. The thicker the projection the shorter it needs to be. As shown in FIGS. 2 and 3, the lengths of the projections in the direction of the H vector is substantially less than that of the dipole ($\lambda/2$) and in fact less than $\lambda/4$.

In practice the dimensions of the posts are decided on empirically by constructing an array of diples and altering the dimensions of the posts until the desired radiation pattern is produced. One set of posts that has been used in practice in an array having a dipole separation of 52 mm projected for a length of 17 mm from the ground plane and were formed from metal strip 15 mm wide and 0.5 mm thick.

Figure 5:
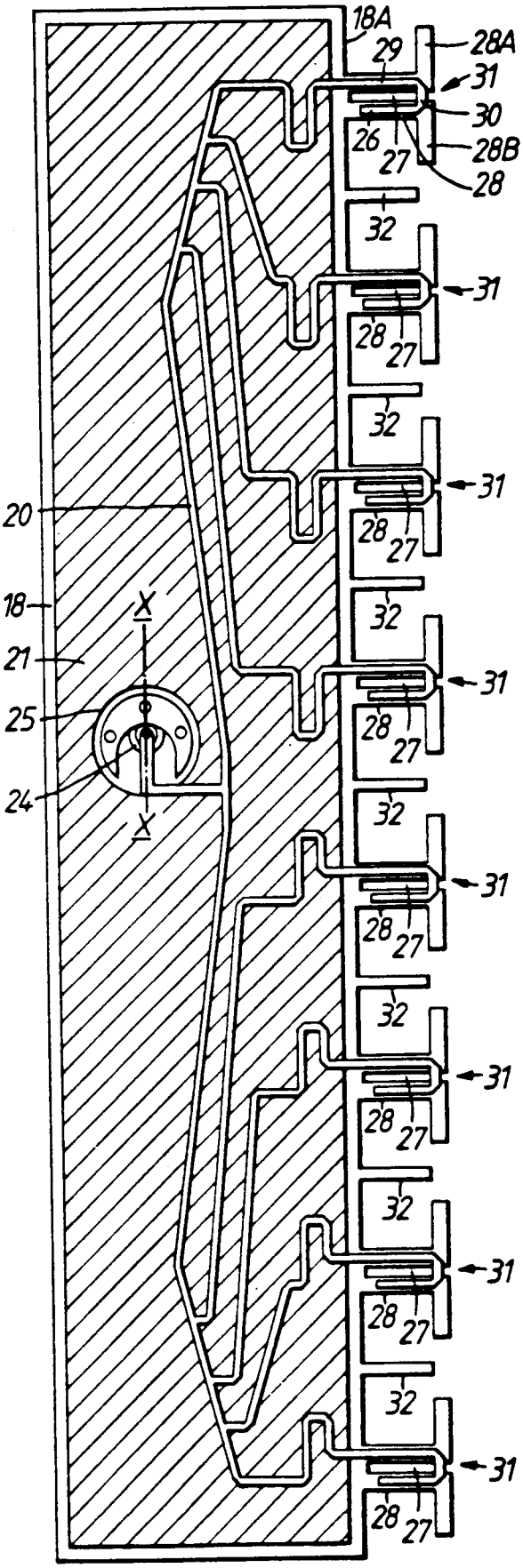
FIG. 5 is a side view of one of a number of vertical triplate systems forming another antenna also constructed in accordance with the invention and shown with one of its earth planes and one of its dielectric sheets removed to reveal the central conductors.

The second embodiment of the invention is built along lines similar to those shown in FIG. 1, but employs a different triplate structure as shown in FIG. 5. The triplate of FIG. 5 comprises two identical earthed conductive sheets or plates 18 and 19 forming the earth planes of the triplate, one of these being removed in the case of FIG. 5. See also FIG. 6. Between the earth plates 18 and 19 are conductive strips 20 separated from the sheets 18 and 19 by insulating layers 21 and 22 of foam plastics material. Layers 18, 19, 21 and 22 are connected together by bolts, (one of which is shown at 23) arranged to establish electrical contact between the earth plates 18 and 19.

Figure 6:
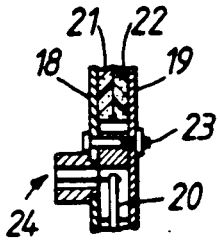
FIG. 6 is a cross-section through the line XX of FIG. 5.

Energy to be transmitted is fed from a co-axial line (not shown but similar to that shown at 9 in FIG. 1) to a co-axial socket 24 shown in more detail in FIG. 6.

From the co-axial socket 24 energy is transmitted to a centre conductive strip 20 of the triplate, an element 25 being included to improve coupling from the co-axial socket to the triplate. From the centre conductive strip 20 the energy is transmitted along circuitous paths to each of an array of dipole elements 31. The routes to the dipoles are arranged to feed energy so that it arrives at the dipoles with a desired phase and amplitude distribution.

Each dipole is formed by two members, each a quarter of a wavelength ($\lambda/4$) long, positioned on the end of an arm, which is also approximately a quarter of a wavelength ($\lambda/4$) long and extends from an edge (e.g., edge 18A of one of the ground planes 18 or 19). The two members and the arm form a T shape. The members of each T are separated by a slot 27 which extends from its open end to a closed end in the arm 28 of the T shape near where it joins the edge, e.g., 18A, of the ground plate 18 or 19.

The conductive strips 20 forming the feeds, terminate at each T shape in a U shaped portion which has a part 29 a quarter wavelength long extending along the arm 28 on one side of the slot 27; a part 30 extending across the slot immediately between the dipoles 28A and 28B formed by the members of the T; and a part 26 which is also a quarter wavelength long and extends back along the arm 28 on the opposite side of the slot to its free end which is just before the closed end of the slot 27. The U shaped portion of a feed strip 20 in co-operation with the arm of the associated T shape, split by the slot 27, forms a balun whose effect is to feed energy to the dipoles so that current always flows in the same direction in the two halves 28A, 28B of the dipole.

Between each dipole 31 is a post 32 (similar in function to posts 17) but formed by protrusions from the ground plates 18 and 19. The free ends of these protrusions 32 lie directly between the members 28A and 28B formed by the dipoles. The effect of the protrusions 32 is the same as that of the protrusions 17 (FIGS. 2 & 3), namely to prevent a substantial amount of mutual coupling between adjacent dipoles.

It will be appreciated that the illustrated embodiments have been described only as an example of two ways in which the invention can be performed. In another configuration the triplate structures could be replaced by stripline energy feeding systems or indeed by waveguides or co-axial cables. Another possibility would be to use two or more projections between each pair of dipoles. Where only one projection is used it is preferably positioned centrally between the dipoles but this is not essential and an offset configuration could also be used.

We claim:

1. An antenna comprising:

a coplanar array of dipoles tuned to electromagnetic signals of a given wavelength $\lambda$ and arranged with respect to orthogonal first, second and third directions in rows extending in the first direction and columns extending in the second direction, a ground plane parallel to said first and second directions, each dipole being spaced in the third direction from said ground plane and having two poles which are aligned in the first direction, and a plurality of individual parasitic conductive posts respectively disposed in the rows, the posts extending from said ground plane in said third direction a distance no greater than $\lambda/4$ and being positioned so as to separate adjacent dipoles in each row, thereby to reduce mutual coupling between said dipoles, said posts having a length in said second direction which is less than $\lambda/2$.

2. An antenna according to claim 1, further including a beam scanning means connected to said dipoles for controlling the relative phases of energy fed to different dipoles so as to scan a direction of maximum gain of said antenna.

3. An antenna as in claim 1, further comprising means for applying a signal of given frequency to said dipoles, said posts having lengths in said third direction tuned for said given frequency to minimize mutual coupling.

4. An antenna as in claim 1, wherein said posts have a length in said second direction which is less than $\lambda/4$.

5. An antenna comprising:

an array of dipoles tuned to electromagnetic signals of a given wavelength $\lambda$ and disposed in an array plane, and arranged with respect to orthogonal first, second and third directions in rows extending in the first direction and columns extending in the second direction, each dipole having two poles which are aligned in the first direction, a ground plane spaced in said third direction from said array plane, and a plurality of separate parasitic, conductive posts respectively disposed in the rows, said posts extending from said ground plane toward said array plane in said third direction a distance no greater than $\lambda/4$ and being positioned so as to separate adjacent dipoles in each row and form a means for absorbing and re-radiating at a low angle to said array plane some radiation emitted by said dipoles, thereby to reduce mutual coupling between said dipoles, said posts having a length in said second direction which is less than $\lambda/2$.

6. An antenna as in claim 5, further comprising beam scanning means connected to said dipoles for controlling relative phases of energy fed to different ones of said dipoles so as to scan a direction of maximum gain of said antenna.

7. An antenna as in claim 5, further comprising means for applying a signal of given frequency to said dipoles, said posts having lengths in said third direction tuned for said given frequency to minimize mutual coupling.

8. An antenna as in claim 5, wherein said posts have a length in said second direction which is less than $\lambda/4$.

* * * * *